US008677878B1

(12) United States Patent
Floyd et al.

(10) Patent No.: US 8,677,878 B1
(45) Date of Patent: Mar. 25, 2014

(54) THERMAL MANAGEMENT OF A PROPULSION CIRCUIT IN AN ELECTROMAGNETIC MUNITION LAUNCHER

(75) Inventors: Mandel Floyd, Alexandria, VA (US); David Lewis Smith, Albuquerque, NM (US); Ronald J. Kaye, Albuquerque, NM (US); Matthew Aubuchon, Escondido, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 323 days.

(21) Appl. No.: 13/279,792

(22) Filed: Oct. 24, 2011

Related U.S. Application Data

(60) Provisional application No. 61/523,664, filed on Aug. 15, 2011.

(51) Int. Cl.
*F41B 6/00* (2006.01)

(52) U.S. Cl.
USPC ..... 89/8; 124/3

(58) Field of Classification Search
USPC ..... 89/8; 124/3
See application file for complete search history.

(56) References Cited

U.S. PATENT DOCUMENTS 4,343,223 A 8/1982 Hawke et al.
4,572,964 A * 2/1986 Honig ..... 307/106
H123 H * 9/1986 Wright, Jr. ..... 89/8
4,642,476 A * 2/1987 Honig ..... 307/108
4,766,336 A * 8/1988 Deis et al. ..... 310/12.07
4,841,181 A * 6/1989 Kemeny et al. ..... 310/12.07
4,858,513 A * 8/1989 Kememy ..... 89/8
4,870,888 A 10/1989 Weldon et al.
4,885,974 A * 12/1989 Honig ..... 89/8
4,913,030 A * 4/1990 Reynolds ..... 89/8
4,926,741 A * 5/1990 Zabar ..... 89/8
4,987,821 A 1/1991 Kemeny et al.
5,007,348 A 4/1991 Pinson
5,024,137 A 6/1991 Schroeder et al.
5,122,506 A 6/1992 Wang
5,125,321 A 6/1992 Cowan, Jr. et al.
5,155,289 A * 10/1992 Bowles ..... 89/8
5,302,872 A 4/1994 Ohki et al.
6,142,131 A 11/2000 Wortman et al.
6,952,086 B1 10/2005 Krefta et al.
6,997,173 B2 2/2006 MacDougall
7,357,128 B1 4/2008 Baumgart
7,549,365 B2 6/2009 Root, Jr.
7,895,931 B2 3/2011 Gaigler et al.

(Continued)

FOREIGN PATENT DOCUMENTS

GB 2030801 A 4/1980

OTHER PUBLICATIONS

Marder, Barry, "A Coilgun Design Primer", "IEEE Transactions on Magnetics", Jan. 1993, vol. 29, No. 1, Publisher: IEEE, Published in: US.

(Continued)

*Primary Examiner* — Michael Carone
*Assistant Examiner* — Reginald Tillman, Jr.
(74) *Attorney, Agent, or Firm* — Kaplan Breyer Schwarz & Ottesen, LLP

(57) ABSTRACT

Apparatus and methods provide thermal management of a propulsion circuit in an electromagnetic munition launcher.

20 Claims, 11 Drawing Sheets

(56) References Cited

U.S. PATENT DOCUMENTS

| | | | | |
|---|---|---|---|---|
| 8,037,799 | B2 * | 10/2011 | Gaigler et al. | 89/8 |
| 2005/0016373 | A1 | 1/2005 | MacDougall | |
| 2006/0027084 | A1 | 2/2006 | Schneider | |
| 2011/0057626 | A1 * | 3/2011 | Scrimshaw et al. | 320/166 |

OTHER PUBLICATIONS

Mongeau, P.P., "Inductively commutated coilguns", "IEEE Xplore http://ieeexplore.ieee.org/xpl/absprintf.jsp?amumber=|01 096 &page=FREE", 2009, Publisher: IEEE, Published in: US.

Skurdal et al., "Multi-Mission Electromagnetic Launcher", 2008, Publisher: Lockheed Martin Corporation.

Kaye, R.J., "Operational requirements and issues for coilgun electromagnetic launchers", "IEEE Xplore http://ieeexplore.ieee.orgixpl/absprintf.jsp ?amumber= 1381536&p.=FREE", 2009, Publisher: IEEE, Published in: US.

"Low Power Multistage Coilgun", "HV Community Forum Archive http://old.4hv.org/index.php?board=5; action=display;threadid=504(1 of9)1/06/2009 2:40:02 PM", , Publisher: YaBB SE.

* cited by examiner

Figure 2A (Prior Art) – Firing State
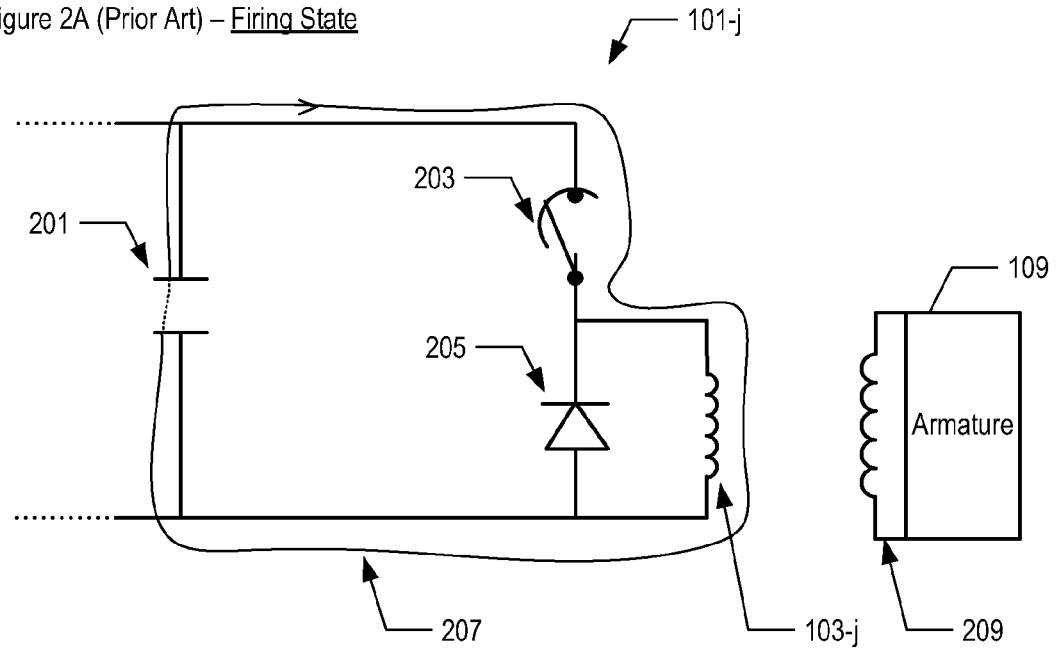
Figure 2B (Prior Art) – Post-Firing State
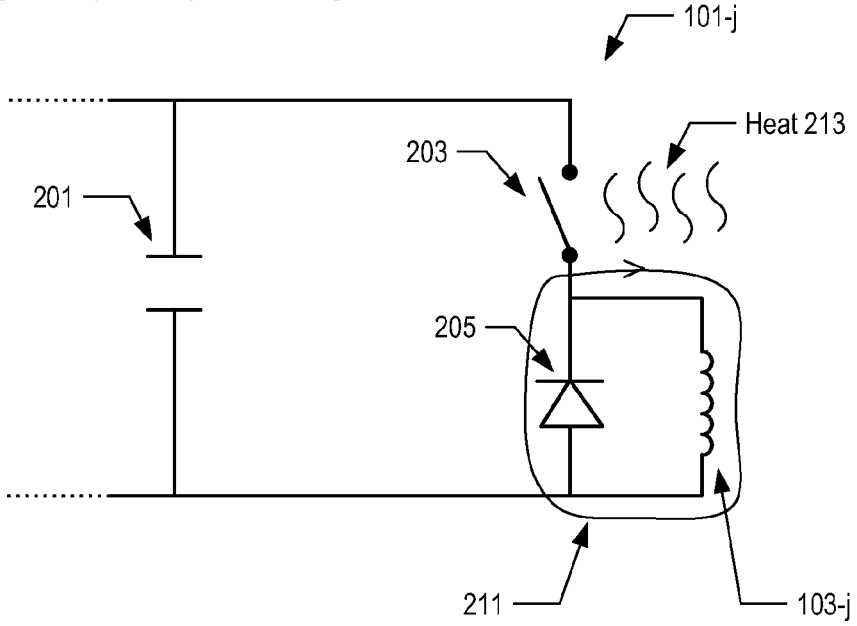

Electromagnetic Munition Launcher 300 with Munition 307

Electromagnetic Munition Launcher 400 with Munition 407

THERMAL MANAGEMENT OF A PROPULSION CIRCUIT IN AN ELECTROMAGNETIC MUNITION LAUNCHER

STATEMENT OF RELATED CASES

This case claims priority to U.S. Provisional Application Ser. No. 61/523,664, filed on 15 Aug. 2011, and which is incorporated by reference herein.

FIELD OF THE INVENTION

The present invention relates to electromagnetic munition launchers in general, and, more particularly, to thermal management thereof.

BACKGROUND OF THE INVENTION

An electromagnetic launcher based on induction coilgun technology comprises coil electromagnets. The coils are sequentially arranged along a launch tube to accelerate a projectile to a desired velocity for launch. The coils are powered on and off in sequence to accelerate the projectile and expel it out of the launch tube. The sequentially-arranged coils and their accompanying circuits are commonly known as the "stages" of the coilgun. See FIG. 1.

The coilgun acts as a linear induction motor with respect to the projectile. The projectile is associated with an armature circuit that is part of, or coupled with, or supports the projectile. When powered, the propulsion coil inductively couples to an armature coil in the armature circuit as it passes the propulsion coil. A coilgun provides no physical contact between the projectile and the propulsion coil. The acceleration is achieved through induction and magnetic forces. In contrast, a railgun uses sliding contacts or rails to transmit energy to the projectile.

Coilguns are often designed by and for hobbyists for low-power applications that shoot light payloads. However, larger systems have been disclosed for defense applications. For example, U.S. Pat. No. 7,549,365 B2 discloses an electromagnetic missile launcher ("EMML") with a catapult-sled that supports a missile as it is being launched. The catapult-sled is electromagnetically accelerated by induction as between armature coils on the catapult-sled and successively arranged propulsion coils along the launch tube. The EMML launcher has multiple cells, each cell being equipped with the coilgun and catapult-sled. The armature is part of the sled that guides, but does not launch with, the projectile. U.S. Pat. No. 7,549,365 B2 is hereby incorporated by reference herein. If there are any contradictions or inconsistencies between the present case and one or more of the cases that are incorporated by reference herein, the claims in the present case are to be interpreted consistent with the language herein.

Another catapult-style electromagnetic launcher is the "Electro Magnetic Countermeasure Launcher" ("EMCL") in U.S. Pat. No. 7,895,931, which is incorporated by reference herein. The illustrative EMCL has a coilgun-based design that uses an electromagnetic catapult to throw a countermeasure device with controlled force and direction, while minimizing the launch signature. The EMCL comprises a launch tube that propels a series of countermeasure payloads. The EMCL typically requires repetitive firings from the same set of propulsion coils in relatively rapid succession (i.e., burst), because the same launch tube is used to launch the series of countermeasure payloads. The equipped armatures are ejected with or as a part of the countermeasure payload. Additional payloads are loaded and then fired from the same launch tube.

One drawback of coilgun-based designs arises from the residual energy that is left over in the propulsion coil(s) and associated propulsion circuitry after firing. The residual energy dissipates as heat in the propulsion coil. See FIG. 2B. The coilgun operator must then wait for the coil to cool down before the coilgun is ready to fire/launch again. Additionally, the excess heat tends to lower the longevity of the coil. In a weapons-grade coilgun, the propulsion coil is an expensive component, and replacing the coil takes a substantial toll on the weapon's maintainability. Moreover, the excess heat makes the weapon vulnerable to infrared detection. FIGS. 1, 2A, and 2B illustrate some of the abovementioned principles of the prior art.

FIG. 1 depicts the salient elements of a typical induction coilgun system in the prior art, including coilgun 100 and projectile 107. Coilgun 100 comprises: propulsion circuits 101-1, 101-2, and 101-3; and launch tube 105; each propulsion circuit 101-*j* comprises propulsion coil 103-*j* and power supply 111-*j*, where j=1, 2, 3. Coilgun 100 is illustrated with three stages, 1, 2, and 3, each stage comprising only one propulsion circuit 101-*j*, but it will be clear to those having ordinary skill in the art that any number of stages and any number of component propulsion circuits per stage are possible.

Propulsion coil 103-*j* is well known in the art; when electrical current flows through it, the propulsion coil is capable of inductively coupling to an armature coil that falls within its inductive influence as it travels through the launch tube.

Launch tube 105 is well known in the art and encloses, supports, and/or guides accelerating projectile 107.

Projectile 107 is accelerated by the launcher to travel in the direction of the arrow as shown. The illustrative projectile 107 comprises armature circuit 109 that, through inductive coupling to the successively arranged propulsion coils 103-*j* in the corresponding propulsion circuits 101-*j*, enables projectile 107 to accelerate out of launch tube 105.

Power supply 111-*j* is well known in the art and acts as a power source to propulsion circuit 101-*j*.

Control sub-systems are not shown in the present figure or in FIGS. 2A and 2B. Electronics (accompanied by hardware and/or software) may be used as the control sub-system in some embodiments of coilgun 100 to operate the coilgun. In some embodiments, the control sub-system is manual.

FIG. 2A depicts the salient elements of prior art propulsion circuit 101-*j* while in the firing state; also shown is armature circuit 109, which is associated with projectile 107 (not shown), and which comprises armature coil 209. Propulsion circuit 101-*j* comprises the following salient electrical components: propulsion coil 103-*j*; capacitor 201; switch 203; and diode 205. Each of these electrical components is well-known in the art. During the firing state, switch 203 is in a closed position and electrical current 207 flows through a loop that comprises capacitor 201, switch 203, and propulsion coil 103-*j*. In the firing state, propulsion coil 103-*j* inductively couples to armature coil 209 as projectile 107 (not shown) accelerates through launch tube 105 (not shown).

FIG. 2B depicts the salient elements of prior art propulsion circuit 101-*j* while in the post-firing state. The post-firing state follows the firing state of FIG. 2A. Propulsion circuit 101-*j* comprises the same salient electrical components as shown in FIG. 2A. During the post-firing state, switch 203 is in an open position and electrical current 211 flows through a loop that comprises diode 205 and propulsion coil 103-*j*.

In the post-firing state, propulsion coil 103-*j* experiences a rise in temperature that arises from residual energy left over from the firing state. As electrical current 211 flows, it heats propulsion coil 103-*j* through resistive dissipation of the coil windings, manifesting as heat 213. As noted, the temperature rise and the heat dissipation are significant drawbacks.

SUMMARY OF THE INVENTION

The inventors of the present invention recognized that in regard to weapons applications of induction coilgun technology, the high levels of energy involved in munitions launches generate an amount of heat and a correspondingly long cooling period that substantially delays how soon the launcher can be ready for the next launch. This delay is not compatible with the rapid-fire needs of munitions launchers that must repetitively launch a sufficient number of munitions in a short time to satisfy mission objectives. The present inventors recognized that the amount of excess heat and the resultant cooling delay can make the difference between a viable weapon and a nonviable one—at least with regard to supporting repetitive fire. An electromagnetic munition launcher according to the present invention incorporates thermal management of the propulsion coils to ameliorate these drawbacks.

The munition is distinct from and not a part of the disclosed launcher. The term "munition" as used in the present disclosure is defined as any item that can be launched from the electromagnetic munition launcher, and can refer to a missile, a countermeasure, an unmanned aerial vehicle (UAV), a projectile, a launch package, etc.; a munition may, but need not, contain a warhead.

The illustrative electromagnetic munition launcher according to the present invention is based on induction coilgun technology that comprises an enhanced propulsion circuit capable of recovering energy after the launcher fires. The energy recovery feature limits how much the temperature rises in the propulsion coil and its associated circuitry after executing a launch. As noted, launching produces residual energy that is left over in the propulsion circuit. Without thermal management, the residual energy ordinarily would dissipate as heat in the propulsion coils. Thus, limiting the rise in temperature reduces the cooling delay and increases the weapon's firing (or repetition) rate; it also reduces the launcher's infrared footprint, and extends the longevity of the propulsion coil. A further benefit is that the prime power source has reduced power demands for charging the launcher prior to the next firing, and therefore can be smaller/lighter/less costly. In the aggregate, having lower weight, volume, and costs are desirable objectives that are advantageously captured in the disclosed electromagnetic munition launcher.

In contrast to an ordinary electromagnetic munition launcher that lacks the disclosed enhancements, the present electromagnetic munition launcher substantially limits the rise in temperature in the launcher's propulsion coils. This is accomplished by recovering the residual energy after every launch. The recovered energy recharges a high-energy capacitor in the enhanced propulsion circuit. The capacitor then discharges in the next launch. According to the present invention, the enhanced propulsion circuit is designed to operate in a plurality of states, defined herein as a drive state, a recovery state, a charging state, and a safe state. See FIG. 10.

The "drive state" enables the launcher to launch a munition. Typically, the launcher has a plurality of propulsion circuits that are sequentially arranged in stages. The propulsion circuits are energized sequentially to accelerate the munition to its proper launch speed. Thus, to achieve the improved firing/launching rate of the launcher, every propulsion circuit in the launcher is enhanced according to the present invention.

The "recovery state" follows the drive state. The recovery state provides the thermal management of the propulsion coils. The enhanced propulsion circuit comprises a high-energy capacitor (or, in some embodiments, a capacitor block) that discharges during the drive state and must be recharged before the next launch can occur. According to the present invention, the high-energy capacitor is recharged, at least in part, in the course of the recovery state. Channeling at least some of the residual energy into recharging the high-energy capacitor keeps the energy from dissipating as excess heat. With the recovery state, the inventors experimentally demonstrated that as little as 15 percent of the residual energy can be converted to heat, while the rest is applied to recharging the high-energy capacitor. In contrast, without energy recovery, as much as 70 percent of the residual energy converts to heat.

Consequently, the recovery state has the effect of substantially limiting the rise in temperature of the propulsion coil and its associated propulsion circuit as compared to the rise in temperature in the absence of the recovery state, i.e., as compared to prior art designs. Therefore, with far less heat to dissipate and a shorter cooling time, the recovery state enables the electromagnetic munition launcher to launch again sooner in a next drive state as compared to launching again in the absence of the recovery state, i.e., as compared to prior art designs. Furthermore, using energy recovery to help charge the high-energy capacitor substantially reduces the performance demands placed upon the primary power source of the launcher. This can translate into a smaller power source that can have lower weight, lower volume, and/or lower costs—all advantageous to the present invention.

It should be noted that the thermal management provided by the recovery state need not be exclusive to the launcher, because in some embodiments, additional thermal management techniques supplement the recovery state, for example, but not limited to, forced air cooling, liquid cooling, improved materials, improved components, etc., depending upon the operational requirements of the launcher (e.g., the firing rate). Thus, in some embodiments, the thermal management provided by the recovery state has the capacity to reduce or eliminate supplemental techniques that would be otherwise employed, resulting in the advantageous effects recited above—namely lower weight, lower volume, and/or lower costs associated with deploying and maintaining the launcher.

The "charging state" charges the high-energy capacitor from a prime power source to prepare the propulsion circuit for the next launch. A charging state that follows the recovery state delivers less charge to the high-energy capacitor, because the recovery state partially recharged it. Consequently, the charging state takes less time when it follows the recovery state as compared to charging after launching, i.e., as compared to prior art designs. Moreover, the launcher is more energy-efficient. The inventors experimentally demonstrated that as much as 20 percent of the power needed to fully charge the high-energy capacitor was recovered through the recovery state.

The "safe state" provides a way to discharge energy present in the propulsion circuit via a load component(s). The safe state is triggered in case of a misfire or for another purpose that requires a safe discharge of energy away from the propulsion coil. The safe state discharges the high-energy capacitor via the load component. In contrast to the recovery state, the safe state relies on heat dissipation in the load component(s) to discharge excess energy. In some embodiments the safe state operates in conjunction with the recovery state.

The enhanced propulsion circuit according to the present invention comprises a plurality of switches. The switches are arranged and electrically coupled such that, depending on the open and closed positions of the respective switches, they actuate one of the disclosed states. By rapidly changing the configuration of the switches at the right time, i.e., actuating the recovery state following a launch (drive state), the significant residual propulsion coil energy is captured and stored for the next launch. Minimizing the energy loss has a major impact on operational efficiency, reduced heating of the propulsion coils, coil lifetimes, launcher repetition rate, and the total number of launcher shots per burst.

An apparatus according to the present invention is a propulsion circuit in an electromagnetic munition launcher that is capable of launching a munition, the propulsion circuit comprising: a first coil that is dimensioned and arranged to inductively couple to a second coil in an armature circuit that is associated with the munition; a high-energy capacitor; a diode having an anode that is dimensioned and arranged to electrically couple to the high-energy capacitor and having a cathode that is dimensioned and arranged to electrically couple to a first terminal of the first coil; and a plurality of switches for actuating a plurality of states of the propulsion circuit, the plurality of states comprising: a drive state that is actuated when a first switch is in a closed position and a second switch is in the closed position, wherein the high-energy capacitor discharges and a first flow of electric current through the first coil inductively couples the first coil to the second coil; a recovery state that follows the drive state, and that is actuated when a third switch is in the closed position while the first and second switches are in an open position, thereby recharging the high-energy capacitor at least in part; and a charging state that is actuated when a fourth switch is in the closed position while the first, second, and third switches are in the open position and no current flows through the first coil, thereby charging the high-energy capacitor from a power source; wherein the recovery state that follows the drive state limits a rise in the temperature of the first coil as compared to the rise in the absence of the recovery state, wherein the rise results from a residual energy arising from the drive state.

A method for thermal management of a propulsion circuit of an electromagnetic munition launcher, according to the present invention, comprises: actuating a charging state in the propulsion circuit, wherein the charging state comprises charging a high-energy capacitor from a power source, and wherein the propulsion circuit comprises the high-energy capacitor and a first coil; actuating a drive state in the propulsion circuit, wherein the drive state comprises discharging the high-energy capacitor at least in part, and further comprises a flow of electric current that flows through the first coil causing it to inductively couple to a second coil in an armature circuit; and following the drive state, actuating a recovery state in the propulsion circuit, wherein the recovery state comprises charging the high-energy capacitor at least in part, and wherein the recovery state limits a rise in the temperature of the first coil as compared to the rise in the absence of the recovery state, and wherein the rise results from a residual energy arising from the drive state.

BRIEF DESCRIPTION OF THE DRAWINGS

FIG. 2A depicts the salient elements of a propulsion circuit in the firing state, according to the prior art.

FIG. 2B depicts the salient elements of a propulsion circuit while in the post-firing state, according to the prior art.

DETAILED DESCRIPTION

Some structures and devices that are well-known in the art are depicted in block diagram form in the figures herein, to keep salient aspects of the present invention from being unnecessarily obscured.

In addition to the terms defined earlier, the following terms are defined for use in this disclosure and in the accompanying claims:

The term "electrically connected" means that two objects are in direct electrical contact without any intervening elements. In other words, the region of contact between the two objects remains at a substantially uniform voltage for substantially any current (neglecting any voltage drop due to the resistivity of the physical connection medium, such as a wire).

The term "electrically coupled" means that two objects are in electrical contact. This can be via direct physical contact (e.g., a plug in an electrical outlet, etc.), via an electrically-conductive intermediate (e.g., a wire that connects devices, etc.), or via intermediate devices, etc. (e.g., a resistor electrically connected between two other electrical devices, etc.). The term does not refer to induction.

The terms "closed position" and "open position" in reference to switch components refer to whether a switch component is conducting electrical current or not conducting, respectively. These terms thus refer to circuit logic and do not necessarily describe a physical position of the switch.

Figure 1:
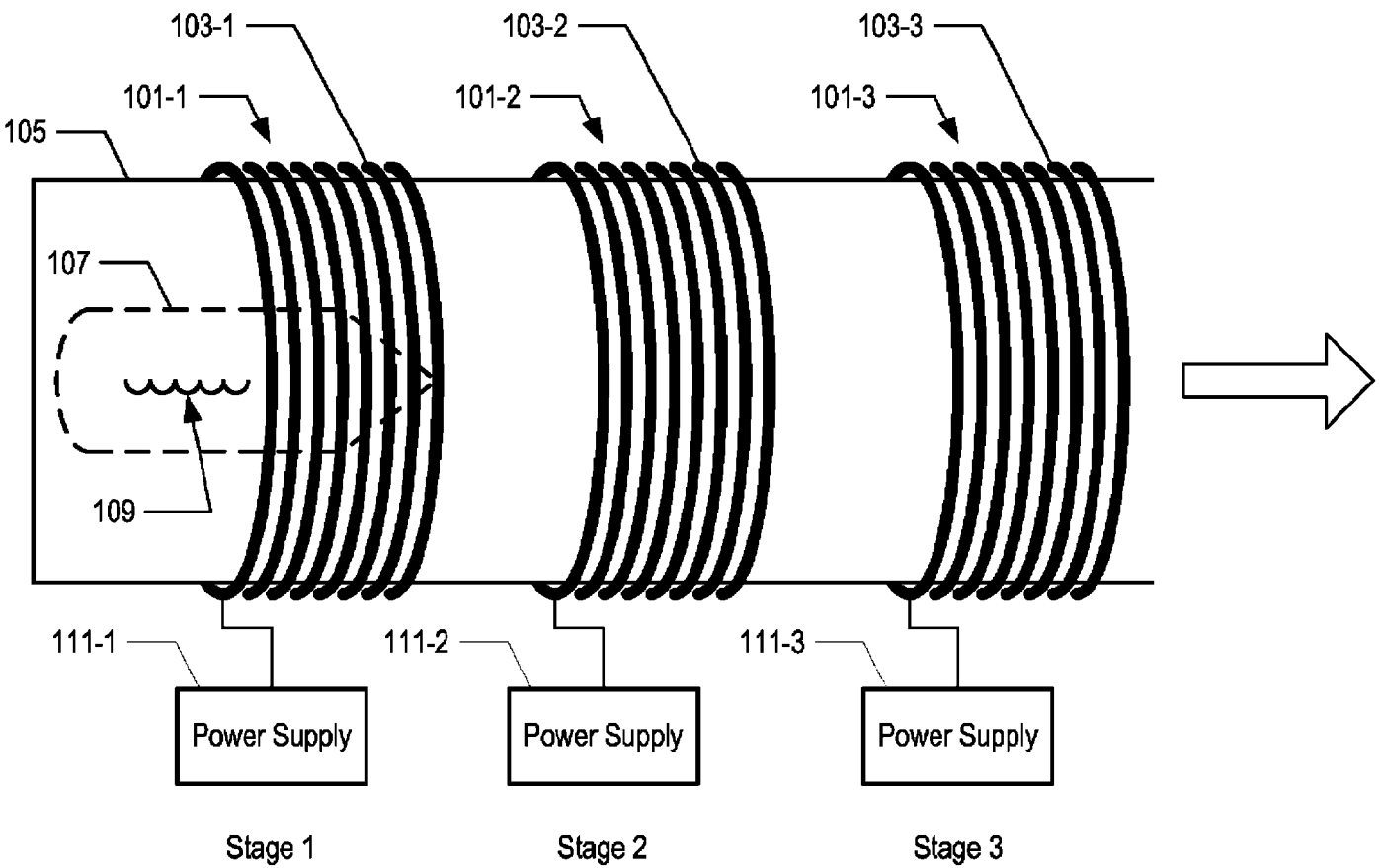
Figure 1 (Prior Art)
FIG. 1 depicts the salient elements of a typical induction coilgun in the prior art.
Figure 3:
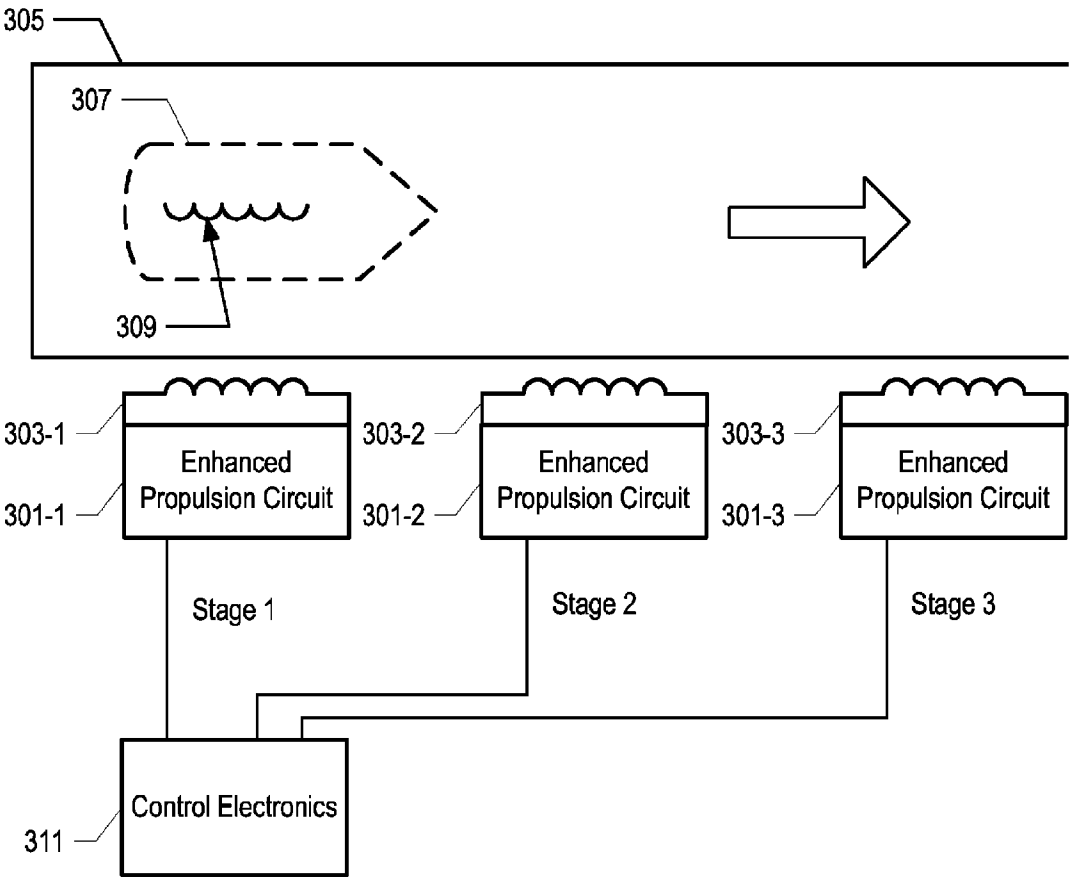
FIG. 3 depicts the salient elements of electromagnetic munition launcher 300 according to a first embodiment of the present invention.

FIG. 3 depicts the salient elements of electromagnetic munition launcher 300 according to a first embodiment of the present invention; munition 307 is also shown. Electromagnetic munition launcher 300 comprises: enhanced propulsion circuits 301-*j*, where j=1, 2, 3; launch tube 305; and control electronics 311. Each propulsion circuit 301-*j* comprises propulsion coil 303-*j*, where j=1, 2, 3. Enhanced propulsion circuit 301-*j* is described in more detail in respect to FIGS. 5 through 8.

Electromagnetic munition launcher 300 is illustrated with three stages—1, 2, and 3—each stage comprising only one enhanced propulsion circuit 301-*j*, but it will be clear to those having ordinary skill in the art, after reading the present disclosure, how to make and use electromagnetic munition launcher 300 with any number of stages; or with any number of enhanced propulsion circuits 301-*j* per stage; or with any combination thereof.

Enhanced propulsion circuit 301-*j* comprises propulsion coil 303-*j* and is discussed in more detail in regard to the subsequent figures. Enhanced propulsion circuit 301-*j* performs the principal functions of the present invention. It should be noted that the figures herein depict the propulsion coils as being physically co-located with the enhanced propulsion circuits, but this is merely illustrative for simplicity and to help enhance understanding of the present invention. Only an electrical coupling as between the propulsion coil(s) and the rest of the enhanced propulsion circuit comprising it (them) is required for proper operation of the illustrative embodiment. In practice, the propulsion coil(s) is physically distant from the rest of the enhanced propulsion circuit in order to accommodate requirements of space, physical arrangement, weight, and cooling that are relevant to the respective embodiment of the present invention.

Launch tube 305 is well known in the art and encloses, supports, and/or guides munition 307 as it accelerates out of launch tube 305.

Munition 307 is accelerated by the launcher to travel in the direction of the arrow as shown. In the illustrative embodiment, munition 307 is a missile. As defined above, munition 307 can be any of a missile, a countermeasure, an unmanned aerial vehicle (UAV), and further, munition 307 may, but need not, contain a warhead. In some embodiments, munition 307 is the same as projectile 107. Munition 307 is not part of electromagnetic munition launcher 300. Munition 307 comprises armature circuit 309.

Armature circuit 309, through inductive coupling of its armature coil to the successively arranged propulsion coils 303-*j* in enhanced propulsion circuits 301-*j*, enables munition 307 to accelerate out of launch tube 305.

Control electronics 311 comprises the control sub-system of electromagnetic munition launcher 300. Control electronics 311 comprises hardware and/or software (executing on a data processor) and connective components that control the operation of enhanced propulsion circuits 301-*j*. In the illustrative embodiment, control electronics 311 controls the operation of electromagnetic munition launcher 300 and comprises the weapons control system that provides targeting and flight information and firing authority to launch munition 307. In some embodiments, control electronics 311 comprises an interface to a separate weapons control system and transmits appropriate commands to the propulsion circuitry and to other components of the launcher. How the weapons control system interfaces with and is physically arranged in respect to control electronics 311 is not relevant to the salient elements of the present invention.

Control electronics 311 actuates power and/or switches that are in enhanced propulsion circuit 301-*j* to activate the launcher and to enable at least some of the operational states that are described in more detail below. Control electronics 311 is capable of sending control signals to enhanced propulsion circuit 301-*j*; control electronics 311 is further capable of monitoring the operation of the individual enhanced propulsion circuits, of the launcher in general, and of the munition and associated armature to the extent necessary to perform its control functions. The relevant interactions between control electronics 311 and respective components of enhanced propulsion circuit 301-*j* are described in more detail in subsequent figures. A person having ordinary skill in the art will recognize, after reading the present disclosure, how to make design trade-offs between control electronics 311 and components of enhanced propulsion circuit 301-*j* to satisfy cost and performance requirements of electromagnetic munition launcher 300. Some embodiments of the present invention comprise more than one control electronics 311.

It will be clear to those having ordinary skill in the art, after reading the present disclosure, how to make and use electromagnetic munition launcher 300. The direction of launch shown herein is illustrative, and it will be clear to those having ordinary skill in the art, after reading the present disclosure, how to make and use electromagnetic munition launcher 300 such that it launches munition 307 in any direction.

Figure 4:
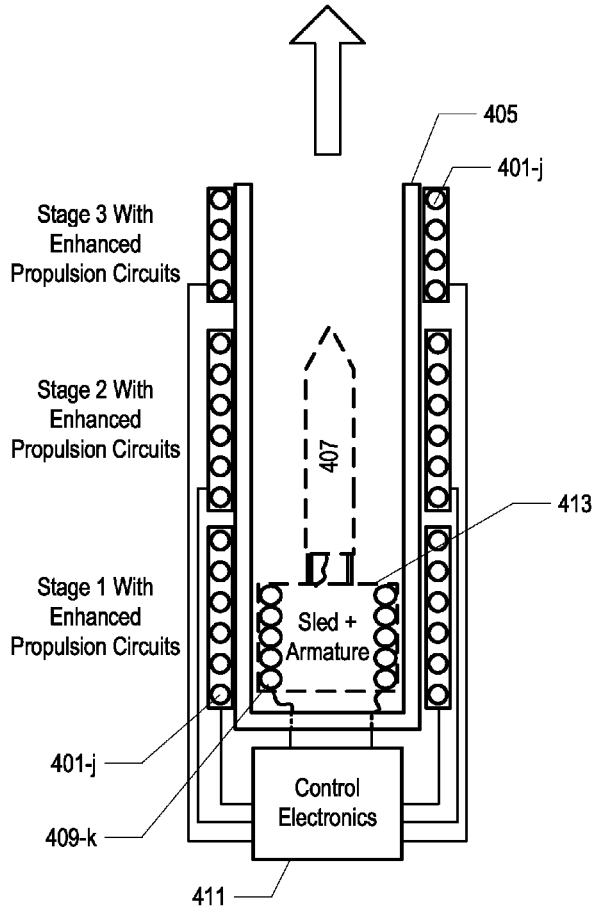
FIG. 4 depicts the salient elements of electromagnetic munition launcher 400 according to a second embodiment of the present invention.

FIG. 4 depicts the salient elements of electromagnetic munition launcher 400 according to a second embodiment of the present invention; munition 407 is also shown. Electromagnetic munition launcher 400 comprises: enhanced propulsion circuits 401-*j*, where j=1 . . . n; launch tube 405; control electronics 411; and sled 413, which comprises armature circuits 409-*k*, where k=1 . . . m.

Electromagnetic munition launcher 400 is illustrated with three stages, 1, 2, and 3, each stage comprising a plurality of enhanced propulsion circuits 401-*j*. It will be clear to those having ordinary skill in the art, after reading the present disclosure, how to make and use electromagnetic munition launcher 400 with any number of stages; or with any number of enhanced propulsion circuits 401-*j* per stage; or with any combination thereof.

Enhanced propulsion circuit 401-*j* is the same as enhanced propulsion circuit 301-*j*. In some embodiments, enhanced propulsion circuit 401-*j* is adapted to the particular architecture of electromagnetic munition launcher 400. It should be noted that the figures herein depict the propulsion coils as being physically co-located with the enhanced propulsion circuits, but this is merely illustrative for simplicity and to help enhance understanding of the present invention. Only an electrical coupling as between the propulsion coil(s) and the rest of the enhanced propulsion circuit comprising it (them) is required for proper operation of the illustrative embodiment. In practice, the propulsion coil(s) is physically distant from the rest of the enhanced propulsion circuit in order to accommodate requirements of space, physical arrangement, weight, and cooling that are relevant to the respective embodiment of the present invention.

Launch tube 405 is well known in the art. In some embodiments, launch tube 405 is the same as launch tube 305; in some alternative embodiments, launch tube 405 comprises other components and functionalities necessary for the operation of sled 413 and the particular architecture of electromagnetic munition launcher 400.

Armature circuit 409-*k* is part of sled 413. In some embodiments, armature circuit 409-*k* operates the same as armature circuit 309. It will be clear to those having ordinary skill in the art, after reading the present disclosure, how to make alternative embodiments that are consistent with electromagnetic munition launcher 400.

Control electronics 411 comprises the control sub-system of electromagnetic munition launcher 400. In the illustrative embodiment, control electronics 411 is the same as control electronics 311, and is further adapted to the particular architecture of electromagnetic munition launcher 400. Like control electronics 311, control electronics 411 actuates power and/or switches that are in enhanced propulsion circuit 401-*j* to enable at least some of the operational states of propulsion circuit 401-*j* as described in more detail below (in regard to enhanced propulsion circuit 301-*j*). Control electronics 411 also controls the operation of sled 413. A person having ordinary skill in the art will recognize, after reading the present disclosure, how to make design trade-offs among functionalities of control electronics 411 and corresponding components of enhanced propulsion circuits 401-*j* and armature circuits 409-*k* to satisfy cost and performance requirements of electromagnetic munition launcher 400. Some embodiments of the present invention comprise more than one control electronics 411.

Sled 413 is part of electromagnetic munition launcher 400 and comprises at least one armature circuit 409-*k* that, through inductive coupling to the successively arranged enhanced propulsion circuits 401-*j*, enables munition 407 to accelerate out of launch tube 405. Thus, according to this second illustrative embodiment, electromagnetic munition launcher 400 comprises the operative armature circuits and armature coils required for the launch of munition 407.

Munition 407 is accelerated to travel in the direction of the arrow as shown. In the illustrative embodiment, munition 407 is a missile. As defined above, munition 407 can be any of a missile, a countermeasure, an unmanned aerial vehicle (UAV), and further, munition 407 may, but need not, contain a warhead. Munition 407 is not part of electromagnetic munition launcher 400.

It will be clear to those having ordinary skill in the art, after reading the present disclosure, how to make and use electromagnetic munition launcher 400. The direction of launch shown herein is illustrative, and it will be clear to those having ordinary skill in the art, after reading the present disclosure, how to make and use electromagnetic munition launcher 400 such that it launches munition 407 in any direction.

Figure 5:
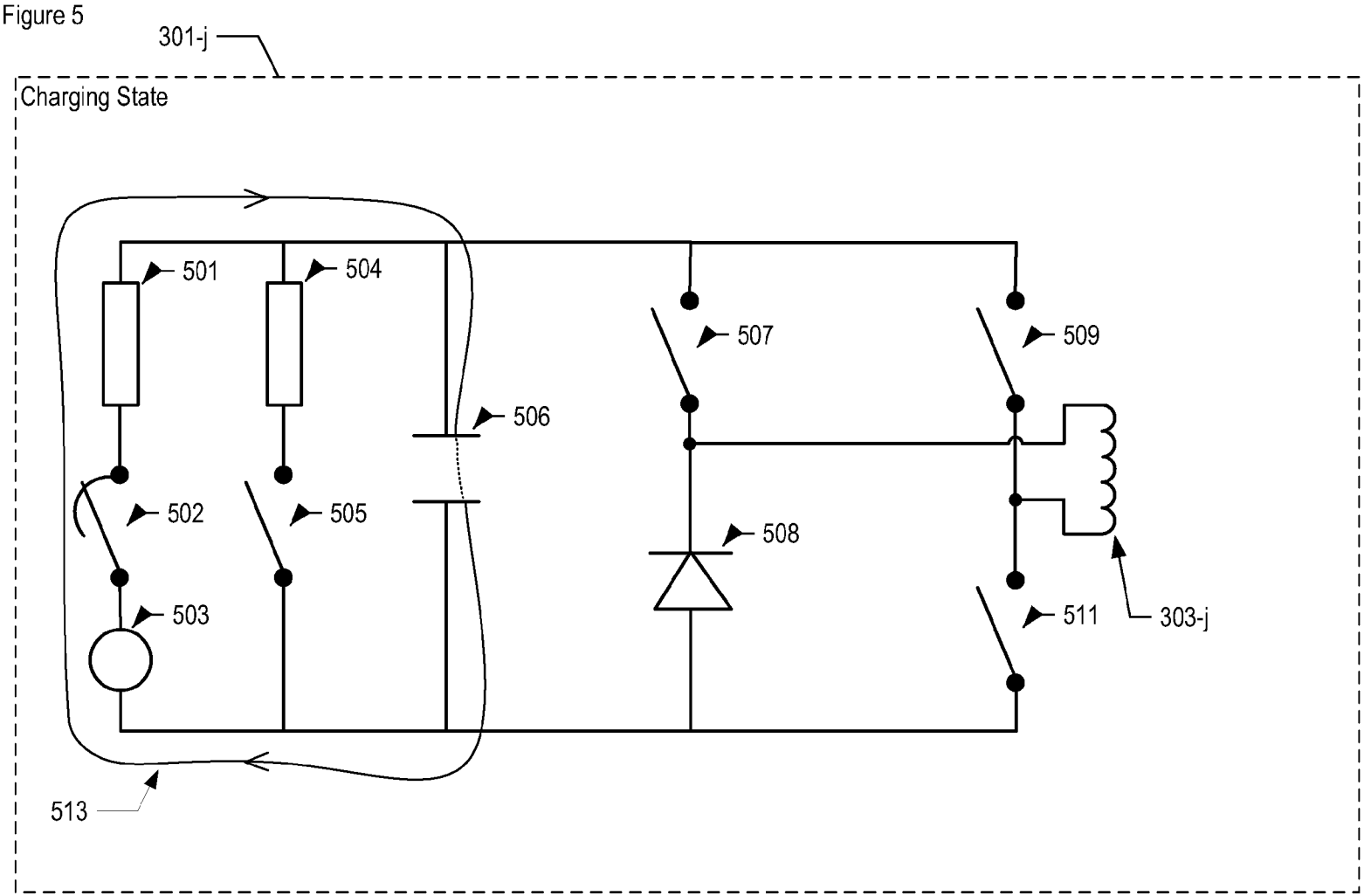
FIG. 5 depicts a circuit diagram of the salient elements of enhanced propulsion circuit 301-*j* operating in the charging state.

FIG. 5 depicts a circuit diagram of the salient elements of enhanced propulsion circuit 301-*j* operating in the charging state according to an embodiment of the present invention. In general, enhanced propulsion circuit 301-*j* comprises the following electrical components: load 501; switch 502; power source 503; load 504; switch 505; high-energy capacitor 506; switch 507; diode 508; switch 509; switch 511; and propulsion coil 303-*j*. Enhanced propulsion circuit 301-*j* functions at least in part under the control of control electronics 311 (not shown), to perform some of the salient operations of electromagnetic munition launcher 300 according to the present invention.

As noted in the Summary, enhanced propulsion circuit 301-*j* according to the illustrative embodiment is designed to operate in a plurality of states: a charging state, a drive state, a recovery state, and a safe state. However, it is to be understood that some alternative embodiments do not operate in all these states and therefore do not require the corresponding components that are illustrated herein. During ordinary operation, enhanced propulsion circuit 301-*j* executes the sequence of charging state, drive state, and recovery state, cycling back to a next sequence of charging state, drive state, and recovery state.

In the charging state, the enumerated components are electrically coupled as illustrated in the present figure. The charging state charges high-energy capacitor 506 from power source 503 to prepare enhanced propulsion circuit 301-*j* for the next launch, i.e., for the drive state. During the charging state, switch 502 is in a closed position and switches 505, 507, 509, and 511 are in an open position; electrical current 513 flows clockwise through a loop that comprises high-energy capacitor 506, power source 503, switch 502, and load 501.

Load 501 is well known in the art. In the illustrative embodiment, load 501 is a resistor, and it will be clear to those having ordinary skill in the art how to make and use load 501 with other components of like functionality.

Switch 502 is well known in the art. Switch 502 actuates the charging state when it is closed—under control of control electronics 311—and the other switches are open. It will be clear to those having ordinary skill in the art how to implement switch 502 with other types of switches or other components of like functionality.

Power source 503 is a power source that is well known in the art. Power source 503 provides the power that charges high-energy capacitor 506 during the charging state. It will be clear to those having ordinary skill in the art how to make and use power source 503.

High-energy capacitor 506 is a capacitor that sustains high voltage and a high discharge rate. High-energy capacitor 506 is suitable for use with enhanced propulsion circuit 301-*j*, because it acts as a pulse power source capable of relatively-rapid charge and discharge. In the illustrative embodiment, high-energy capacitor 506 sustains high voltage for up to 60 seconds, and it will be clear to those having ordinary skill in the art, after reading the present disclosure, how to select and use other suitable high-energy capacitors. In some embodiments, high-energy capacitor 506 is a block comprising a plurality of high-energy capacitors.

It will be clear to those having ordinary skill in the art, after reading the present disclosure, how to make and use enhanced propulsion circuit 301-*j* in the charging state. The remaining components illustrated in FIG. 5 are described in more detail in the figures below.

Figure 6A:
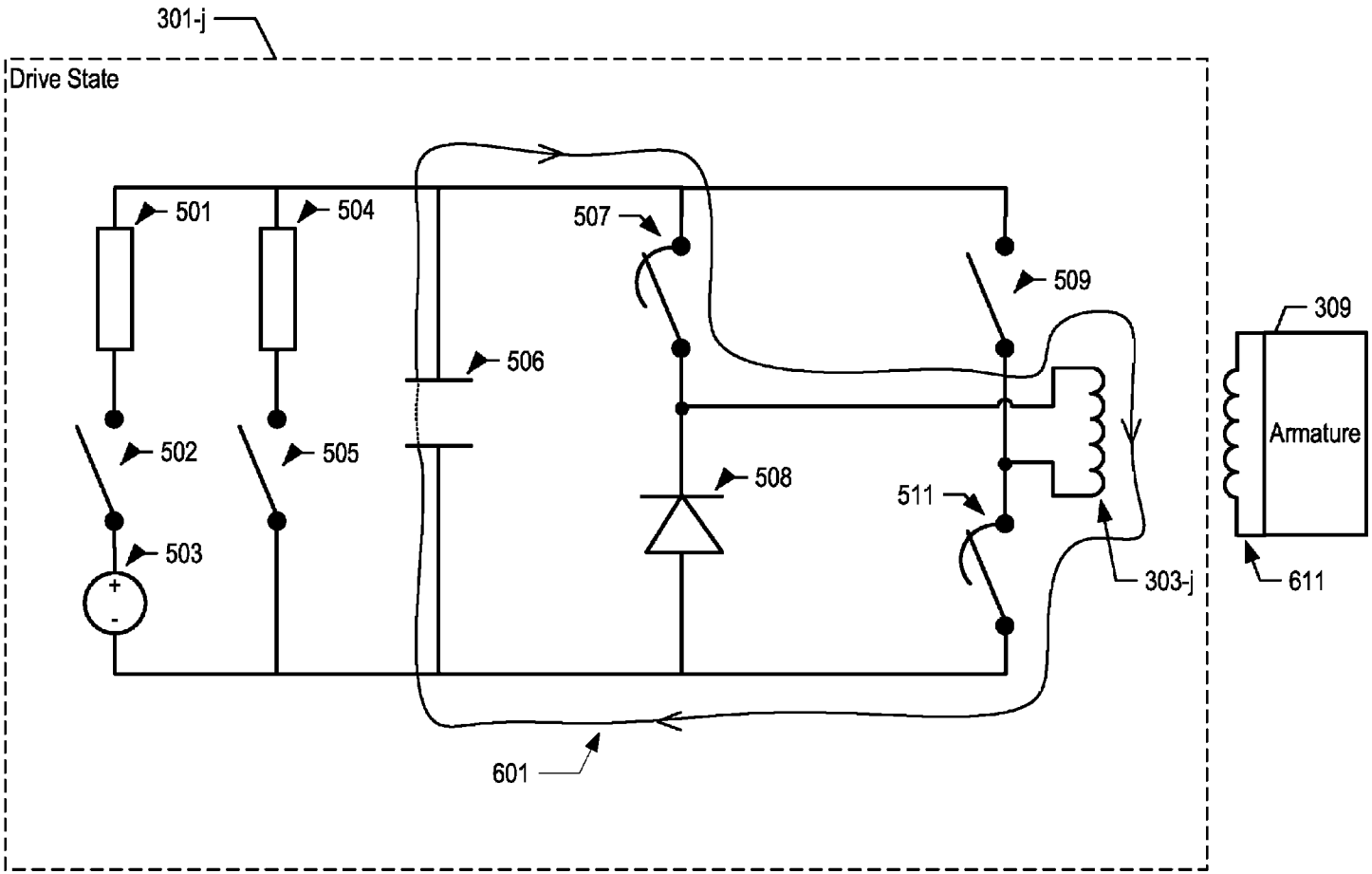
FIG. 6A depicts a circuit diagram of the salient elements of enhanced propulsion circuit 301-*j* operating in a first phase of the drive state.
Figure 6B:
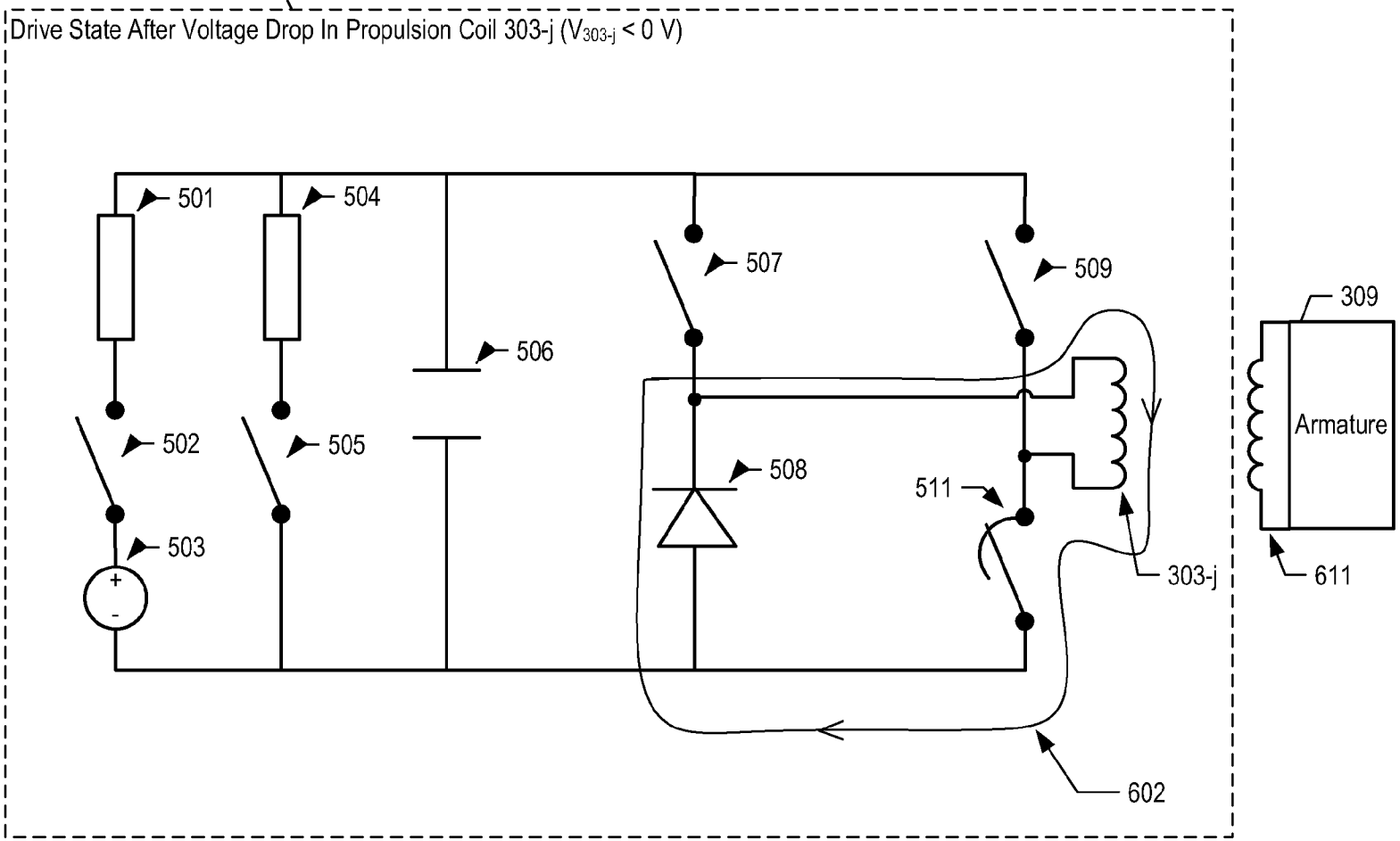
FIG. 6B depicts a circuit diagram of the salient elements of enhanced propulsion circuit 301-*j* operating in a second phase of the drive state.

FIGS. 6A and 6B depict circuit diagrams of the salient elements of enhanced propulsion circuit 301-*j* operating in the drive state according to an embodiment of the present invention; also shown is armature circuit 309, which is associated with projectile 307 (not shown), and which comprises armature coil 611. In the drive state, armature circuit 309 falls under the inductive influence of propulsion coil 303-*j* as munition 307 travels past propulsion coil 303-*j*. At a certain level of granularity the drive state can be depicted in two phases, as illustrated by FIGS. 6A and 6B. Enhanced propulsion circuit 301-*j* comprises the electrical components enumerated in FIG. 5, which are electrically coupled according to FIGS. 6A and 6B.

FIG. 6A depicts a circuit diagram of the salient elements of enhanced propulsion circuit 301-*j* operating in a first phase of the drive state. Electrical current 601 flows clockwise through a loop that comprises high-energy capacitor 506; switch 507 in a closed position; propulsion coil 303-*j*; and switch 511 in a closed position. Switches 502, 505, and 509 are in an open position.

High-energy capacitor 506 was described above. High-energy capacitor 506 discharges to provide "pulse" power to propulsion coil 303-*j* during the drive state.

Switch 507 in the illustrative embodiment is a latching-type semiconductor (thyristor). One or more trigger pulses from control electronics 311 is driven into the gate terminal of switch 507 until a latching current level is established through the switch sufficient to latch switch 507 on (in a closed position). In the illustrative embodiment, the latching current is about 500 mA. Switch 507 remains latched on until the electrical current through the switch drops below a holding current level. In the illustrative embodiment, the holding current level is about 300 mA.

Switch 511 is not a latching switch like switch 507, and its conduction path can be closed and opened under the control of a gate terminal regardless of current level. Switch 511 is triggered into the closed position by control electronics 311 before triggering switch 507. It will be clear to those having ordinary skill in the art, after reading the present disclosure, how to use a latching-type switch 511 in alternative embodiments of the present circuit, possibly requiring a corresponding alternative implementation of control electronics 311.

It will be clear to those having ordinary skill in the art, after reading the present disclosure, how to make and use alternative embodiments of the present invention using alternative switch technologies, whether latching or non-latching or otherwise, in conjunction with appropriate support in control electronics 311 or elsewhere in electromagnetic munition launcher 300. Likewise, some alternative embodiments use a different number and/or a different arrangement of switches to perform the functions disclosed in the present figure and in the other figures associated with the present invention.

FIG. 6B depicts a circuit diagram of the salient elements of enhanced propulsion circuit 301-*j* operating in a second phase of the drive state. During the drive state, when the LC resonant circuit of high-energy capacitor 506 and propulsion coil 303-*j* in conjunction with armature circuit 309 force the voltage across propulsion coil 303-*j* below 0 Volts, switch 507 is forced off (into an open position) and diode 508 is forced on. The electrical current through switch 507 falls below the holding current level of FIG. 6A, thus forcing switch 507 off (open position). The current flow is picked up by diode 508, as shown, and the voltage across propulsion coil 303-*j* is clamped to a low voltage by diode 508. Resultant electrical current 602 flows clockwise through a loop comprising diode 508, propulsion coil 303-*j*, and switch 511 in the closed position.

Figure 7:
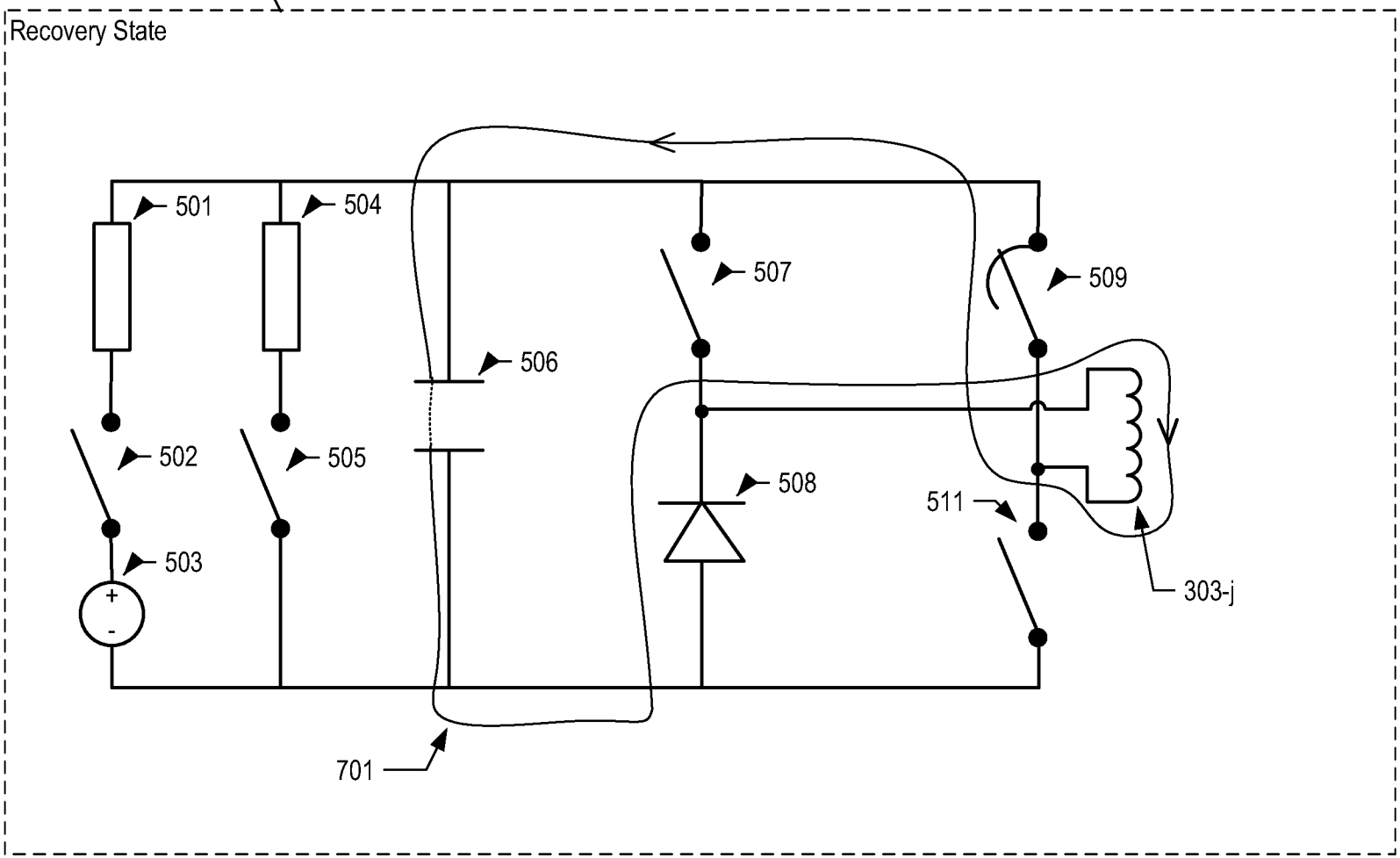
FIG. 7 depicts a circuit diagram of the salient elements of enhanced propulsion circuit 301-*j* operating in the recovery state.

FIG. 7 depicts a circuit diagram of the salient elements of enhanced propulsion circuit 301-*j* operating in the recovery state according to an embodiment of the present invention. Enhanced propulsion circuit 301-*j* comprises the electrical components enumerated in FIG. 5, which are electrically coupled according to the present figure.

The recovery state follows the drive state. When armature circuit 309, which is associated with munition 307 (not shown), moves sufficiently out of the inductive influence of propulsion coil 303-*j*, control electronics 311 opens switch 511 and triggers switch 509 closed. Electrical current 701 flows counterclockwise through a loop comprising high-energy capacitor 506, diode 508, propulsion circuit 303-*j*, and switch 509 in a closed position. Switches 502, 505, 507, and 511 are in the open position. The direction of flow through high-energy capacitor 506 is opposite to the direction of flow during the drive state of FIG. 6A.

High-energy capacitor 506 was described above.

Switch 509 is a non-latching switch. It will be clear to those having ordinary skill in the art, after reading the present disclosure, how to use a latching-type switch 509 in alternative embodiments of the present circuit.

The current flow in the recovery state has the effect of charging, at least in part, high-energy capacitor 506. This provides the thermal management feature of the electromagnetic munition launcher according to the present invention. As a result of the above-described drive state, the residual energy that arises in the drive state manifests as current that flows through propulsion coil 303-*j* as shown in FIG. 6B; ordinarily, this would cause propulsion coil 303-*j* to heat up substantially—similar to the prior art circuit of FIG. 2B. However, by actuating the recovery state according to the present invention, the temperature rise in propulsion coil 303-*j* is substantially limited. Thus, before another launch is attempted, the residual energy is recovered and channeled into recharging high-energy capacitor 506 during the recovery state. The recovery state typically charges high-energy capacitor 506 only in part, leaving the full-level charging to a subsequent charging state that typically follows the recovery state. The extent of recharge received by high-energy capacitor 506 during the recovery state relative to the charging state depends on the implementation of enhanced propulsion circuit 301-*j* and control electronics 311.

In a multi-stage launcher, a plurality of propulsion coils is arranged in succession along the launch tube. Therefore, each enhanced propulsion circuit that comprises the respective propulsion coil(s) is capable of operating in the drive state followed by the recovery state. Therefore, the drive state manifesting in each successive propulsion coil provides acceleration to the munition being launched. The recovery state that follows the drive state of each enhanced propulsion circuit enables the electromagnetic munition launcher to launch again sooner in a next drive state of the respective propulsion circuit as compared to launching again in the absence of the recovery state, the recovery state thereby increasing a launching capacity and repetitive rate of the launcher.

It will be clear to those having ordinary skill in the art, after reading the present disclosure, how to make and use the recovery state according to the present invention.

Figure 8:
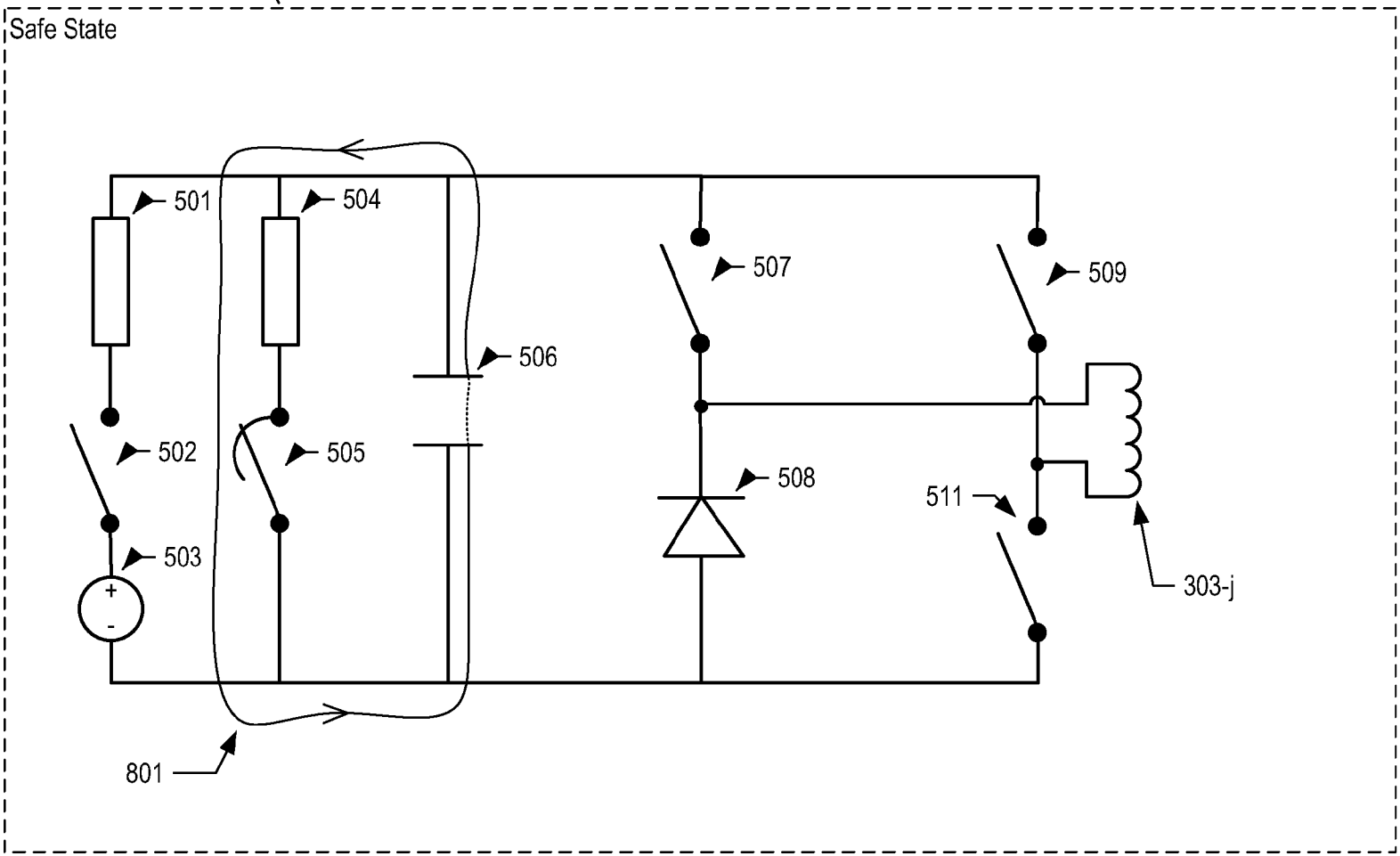
FIG. 8 depicts a circuit diagram of the salient elements of enhanced propulsion circuit 301-*j* operating in the safe state.

FIG. 8 depicts a circuit diagram of the salient elements of enhanced propulsion circuit 301-*j* operating in the safe state according to an embodiment of the present invention. Enhanced propulsion circuit 301-*j* comprises the electrical components enumerated in FIG. 5, which are electrically coupled as shown in the present figure. Electrical current 801 flows counterclockwise through a loop that comprises high-energy capacitor 506; load 504, and switch 505 in a closed position. Switches 502, 507, 509, and 511 are in an open position. The safe state is triggered by control electronics 311 in case of a misfire or for another purpose that requires a rapid discharge of energy away from propulsion coil 303-*j*. In contrast to the recovery state, the safe state dissipates energy as heat. The safe state discharges high-energy capacitor 506 via load component 504.

Load 504 is well known in the art. In the illustrative embodiment, load 504 is a resistor, and it will be clear to those having ordinary skill in the art how to make and use load 504 using one or more other components of like functionality. Load 504 is capable of dissipating heat arising from discharging of high-energy capacitor 506.

Switch 505 is well known in the art. Switch 505 actuates the charging state when control of control electronics 311 triggers switch 505 closed and opens the other switches. It will be clear to those having ordinary skill in the art how to implement switch 505 using other types of switches or other components of like functionality.

High-energy capacitor 506 was described above. The safe state discharges high-energy capacitor 506.

It will be clear to those having ordinary skill in the art, after reading the present disclosure, how to make and use the safe state according to the present invention. It should be noted that, by dissipating heat, the safe state provides a thermal management function that is distinct from the thermal management provided by the recovery state, because it does not partially recharge the high-energy capacitor.

In an alternative embodiment, switch 509 is in a closed position such that both the safe state and the recovery state are simultaneously actuated. This combination enables a faster discharge of the residual energy as compared to using the recovery state alone, and thus provides for a shorter cooling interval before the next drive state is possible.

Figure 9:
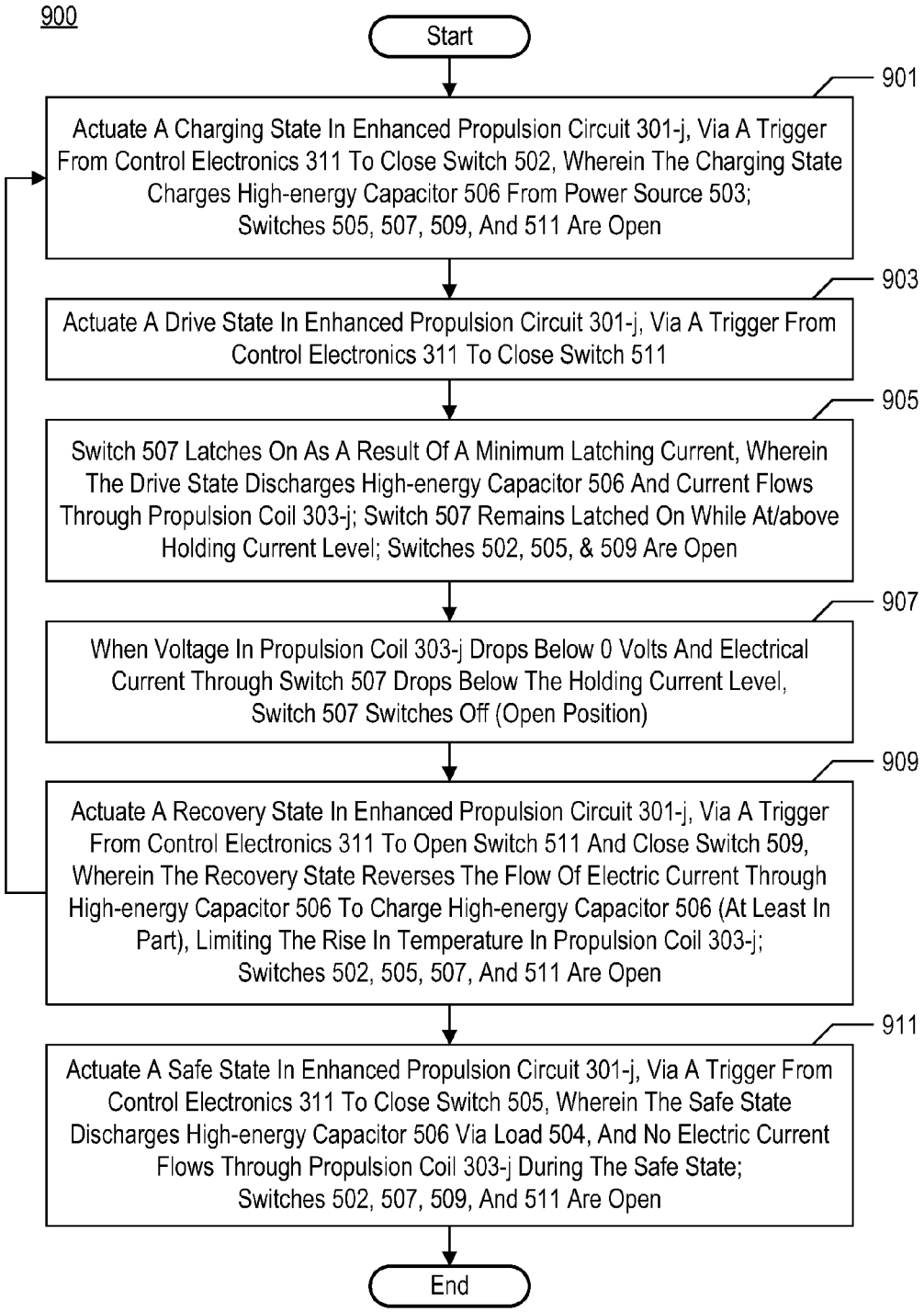
FIG. 9 depicts the salient operations of method 900 according to an embodiment of the present invention.

FIG. 9 depicts the salient operations of method 900 according to an embodiment of the present invention. Method 900 recites the salient operations of the electromagnetic munition launcher of the present invention, including the operations of the charging state, the drive state, the recovery state, and the safe state.

At operation 901, electromagnetic munition launcher 300/400 actuates a charging state in enhanced propulsion circuit 301-*j*, via a trigger from control electronics 311 to close switch 502, wherein the charging state charges high-energy capacitor 506 from power source 503; switches 505, 507, 509, and 511 are open in the charging state.

At operation 903, electromagnetic munition launcher 300/400 actuates a drive state in enhanced propulsion circuit 301-*j*, via a trigger from control electronics 311 to close switch 511.

At operation 905, switch 507 latches on (closed position) as a result of a latching current, wherein the drive state discharges high-energy capacitor 506 and current flows through propulsion coil 303-*j*; switch 507 remains on (closed) while at or above the holding current level; switches 502, 505, and 509 are open during the drive state.

At operation 907, when voltage in propulsion coil 303-*j* drops below 0 Volts and the electrical current through switch 507 drops below the holding current level, switch 507 switches off (open position).

At operation 909, electromagnetic munition launcher 300/400 actuates a recovery state in enhanced propulsion circuit 301-*j*, via a trigger from control electronics 311 to open switch 511 and close switch 509, wherein the recovery state reverses the flow of electric current through high-energy capacitor 506 to charge high-energy capacitor 506 (at least in part), limiting the rise in temperature in propulsion coil 303-*j*; switches 502, 505, 507, and 511 are open during the recovery state.

At operation 911, electromagnetic munition launcher 300/400 actuates a safe state in enhanced propulsion circuit 301-*j*, via a trigger from control electronics 311 to close switch 505, wherein the safe state discharges high-energy capacitor 506 via load 504, and no electric current flows through propulsion coil 303-*j* during the safe state; switches 502, 507, 509, and 511 are open during the safe state.

It will be clear to those having ordinary skill in the art, after reading the present disclosure, how to subdivide, combine, take subsets, and otherwise manipulate the operations of method 900 to implement an alternative method that falls within the scope of the present invention. It is to be further understood that these operations can be achieved by alternative embodiments that feature different implementations of the present invention.

Figure 10:
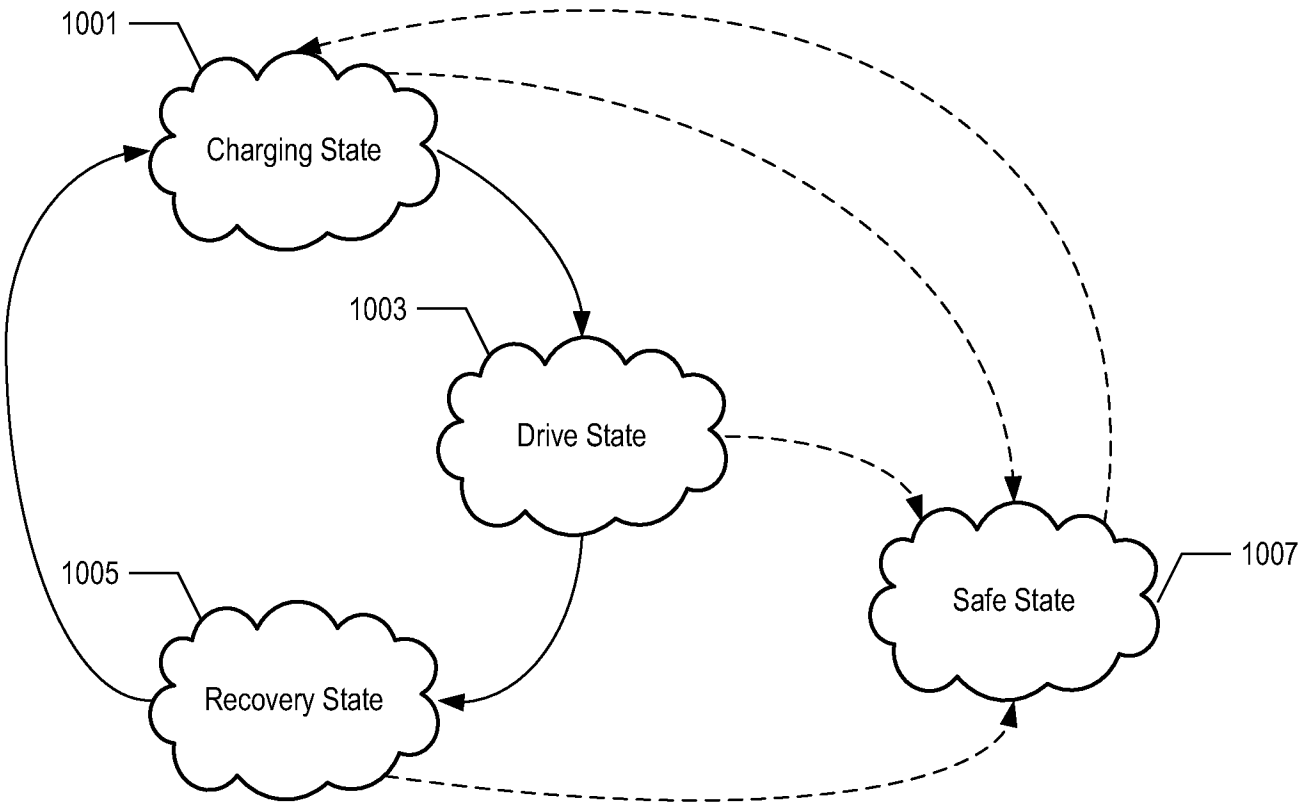
FIG. 10 depicts the salient operational states of enhanced propulsion circuit 301-*j*.

FIG. 10 depicts the salient operational states of enhanced propulsion circuit 301-*j*. FIG. 10 depicts the typical sequence of operational states comprising charging state 1001, followed by drive state 1003, followed by recovery state 1005, followed by the next charging state 1001—as indicated by the solid-line arrows in the figure. Safe state 1007 can follow any of the other states, and charging state 1001 typically follows safe state 1007—as indicated by the dotted-line arrows in the figure.

It is to be understood that the present disclosure teaches some examples of the illustrative embodiments and that many variations of the invention can easily be devised by those skilled in the art after reading this disclosure and that the scope of the present invention is to be determined by the following claims.

What is claimed is:

1. A propulsion circuit in an electromagnetic munition launcher that is capable of launching a munition, the propulsion circuit comprising:

a first coil that is dimensioned and arranged to inductively couple to a second coil in an armature circuit that is associated with the munition;

a high-energy capacitor;

a diode having an anode that is dimensioned and arranged to electrically couple to the high-energy capacitor and having a cathode that is dimensioned and arranged to electrically couple to a first terminal of the first coil; and a plurality of switches for actuating a plurality of states of the propulsion circuit, the plurality of states comprising:

a drive state that is actuated when a first switch is in a closed position and a second switch is in the closed position, wherein the high-energy capacitor discharges and a first flow of electric current through the first coil inductively couples the first coil to the second coil;

a recovery state that follows the drive state, and that is actuated when a third switch is in the closed position while the first and second switches are in an open position, thereby recharging the high-energy capacitor at least in part; and a charging state that is actuated when a fourth switch is in the closed position while the first, second, and third switches are in the open position and no current flows through the first coil, thereby charging the high-energy capacitor from a power source;

wherein the recovery state that follows the drive state limits a rise in the temperature of the first coil as compared to the rise in the absence of the recovery state, wherein the rise results from a residual energy arising from the drive state.

2. The propulsion circuit of claim 1 wherein the plurality of states further comprises:

a safe state that is actuated when a fifth switch is in the closed position while the first, second, third, and fourth switches are in the open position and no current flows through the first coil, thereby discharging the high-energy capacitor via a second flow of electric current through a first load component.

3. The propulsion circuit of claim 2 wherein, when the third switch remains in the closed position while the safe state is actuated, the safe state operates in conjunction with the recovery state.

4. The propulsion circuit of claim 1 wherein the recovery state that follows the drive state enables the electromagnetic munition launcher to launch again sooner in a next drive state as compared to launching again in the absence of the intervening recovery state.

5. The propulsion circuit of claim 1 wherein, in the drive state, the first switch is electrically coupled to a first terminal of the first coil and to a first terminal of the high-energy capacitor, and wherein the second switch is electrically coupled to a second terminal of the first coil and to a second terminal of the high-energy capacitor.

6. The propulsion circuit of claim 1 wherein, in the recovery state, the third switch is electrically coupled to a second terminal of the first coil and to a first terminal of the high-energy capacitor, and wherein a first diode is electrically coupled to a first terminal of the first coil and to a second terminal of the high-energy capacitor.

7. The propulsion circuit of claim 1 wherein the propulsion circuit is one of a plurality of propulsion circuits in the electromagnetic munition launcher, each propulsion circuit being capable of operating in the drive state followed by the recovery state;

wherein a plurality of coils corresponding to the plurality of propulsion circuits are arranged in succession along a launch tube of the electromagnetic munition launcher; and wherein the drive state of each propulsion circuit provides, via the corresponding successive coil, an acceleration to the munition being launched.

8. The propulsion circuit of claim 1 wherein the munition is one of a missile, a countermeasure, an unmanned aerial vehicle (UAV), a projectile, and a launch package.

9. The propulsion circuit of claim 1 wherein the recovery state is also actuated when a voltage across the first coil drops below zero Volts.

10. An electromagnetic munition launcher comprising:

a launch tube that accommodates a munition to be launched; and a propulsion circuit that comprises a first coil, a high-energy capacitor, and a plurality of switches for actuating a plurality of states of the propulsion circuit, the plurality of states comprising:

a drive state that is actuated when a first switch is in a closed position and a second switch is in the closed position, wherein the high-energy capacitor discharges and a first flow of current through the first coil inductively couples the first coil to a second coil in an armature circuit that is associated with the munition;

a recovery state that follows the drive state, and that is actuated when a third switch is in the closed position while the first and second switches are in an open position, thereby recharging the high-energy capacitor at least in part; and a charging state that is actuated when a fourth switch is in the closed position while the first, second, and third switches are in the open position and no current flows through the first coil, thereby charging the high-energy capacitor from a power source;

wherein the recovery state that follows the drive state limits a rise in the temperature of the first coil as compared to the rise in the absence of the recovery state, wherein the rise results from a residual energy arising from the drive state.

11. The electromagnetic munition launcher of claim 10 wherein the plurality of states further comprises:

a safe state that is actuated when a fifth switch is in the closed position while the first, second, third, and fourth switches are in the open position and no current flows through the first coil, thereby discharging the high-energy capacitor via a second flow of electric current through a first load component.

12. The electromagnetic munition launcher of claim 10 wherein the recovery state that follows the drive state and operates before the charging state enables the propulsion circuit to reach the charging state sooner as compared to reaching the charging state in the absence of the intervening recovery state.

13. The electromagnetic munition launcher of claim 10 wherein the recovery state enables some residual energy to be recovered for charging the high-energy capacitor during the recovery state.

14. The electromagnetic munition launcher of claim 10 further comprising:

a plurality of propulsion circuits, each propulsion circuit being capable of operating in the drive state followed by the recovery state;

wherein a plurality of coils corresponding to the plurality of propulsion circuits are arranged in succession along the launch tube; and wherein the drive state of each propulsion circuit provides, via the corresponding successive coil, an acceleration to the munition being launched.

15. The electromagnetic munition launcher of claim 14 wherein the recovery state that follows the drive state of each propulsion circuit enables the electromagnetic munition launcher to launch again sooner in a next drive state of the respective propulsion circuit as compared to launching again in the absence of the recovery state, the recovery state thereby increasing a launching capacity of the electromagnetic munition launcher.

16. A method for thermal management of a propulsion circuit of an electromagnetic munition launcher, the method comprising:

actuating a charging state in the propulsion circuit, wherein the charging state comprises charging a high-energy capacitor from a power source, and wherein the propulsion circuit comprises the high-energy capacitor and a first coil;

actuating a drive state in the propulsion circuit, wherein the drive state comprises discharging the high-energy capacitor at least in part, and further comprises a flow of electric current that flows through the first coil causing it to inductively couple to a second coil in an armature circuit; and following the drive state, actuating a recovery state in the propulsion circuit, wherein the recovery state comprises charging the high-energy capacitor at least in part, and wherein the recovery state limits a rise in the temperature of the first coil as compared to the rise in the absence of the recovery state, and wherein the rise results from a residual energy arising from the drive state.

17. The method of claim 16 further comprising:

actuating a safe state in the propulsion circuit, wherein the safe state discharges the high-energy capacitor via a load, and wherein no electric current flows through the propulsion coil during the safe state.

18. The method of claim 16 further comprising:

actuating a next charging state in the propulsion circuit;

wherein the recovery state that follows the drive state and operates before the next charging state enables the propulsion circuit to reach the next charging state sooner as compared to actuating the next charging state absent the intervening recovery state.

19. The method of claim 16 further wherein:

the actuating of the drive state comprises closing a first switch and a second switch in the propulsion circuit, and wherein the first switch is electrically coupled to a first terminal of the first coil and to a first terminal of the high-energy capacitor, and wherein the second switch is electrically coupled to a second terminal of the first coil and to a second terminal of the high-energy capacitor;

the actuating of the recovery state comprises opening the first switch and the second switch and closing a third switch in the propulsion circuit, and wherein the third switch is electrically coupled to a second terminal of the first coil and to a first terminal of the high-energy capacitor, and wherein a first diode is electrically coupled to a first terminal of the first coil and to a second terminal of the high-energy capacitor; and the thermal management of the propulsion circuit is enabled by actuating the recovery state immediately following the drive state.

20. The method of claim 16 further comprising:

successively actuating the recovery state following the drive state for each of a plurality of propulsion circuits in the electromagnetic munition launcher, wherein a plurality of coils corresponding to the plurality of propulsion circuits are arranged in succession along a launch tube, and wherein the drive state of each propulsion circuit provides, via each successive corresponding coil, an acceleration to a munition being launched by the electromagnetic munition launcher.

* * * * *